US010449746B2

(12) United States Patent
Bretting

(10) Patent No.: US 10,449,746 B2
(45) Date of Patent: Oct. 22, 2019

(54) WEB PROCESSING SYSTEM WITH MULTIPLE FOLDING ARRANGEMENTS FED BY A SINGLE WEB HANDLING ARRANGEMENT

(71) Applicant: Richard D. Bretting, Ashland, WI (US)

(72) Inventor: Richard D. Bretting, Ashland, WI (US)

(73) Assignee: C. G. Bretting Manufacturing Co., Inc., Ashland, WI (US)

( * ) Notice: Subject to any disclaimer, the term of this patent is extended or adjusted under 35 U.S.C. 154(b) by 327 days.

(21) Appl. No.: 15/194,184

(22) Filed: Jun. 27, 2016

(65) Prior Publication Data

US 2017/0368781 A1 Dec. 28, 2017

(51) Int. Cl.

| | |
|---|---|
| ***B31D 1/04*** | (2006.01) |
| ***B65H 29/70*** | (2006.01) |
| ***B65H 35/08*** | (2006.01) |
| ***B65H 45/24*** | (2006.01) |

(52) U.S. Cl.

CPC ..... *B31D 1/04* (2013.01); *B65H 29/70* (2013.01); *B65H 35/08* (2013.01); *B65H 45/24* (2013.01); *B65H 2513/108* (2013.01)

(58) Field of Classification Search

CPC ..... B31D 1/04; B65H 45/24; B65H 29/70; B65H 35/08; B65H 2513/108

USPC ..... 493/356, 360, 405, 418, 424, 430, 433, 493/434, 442, 448, 451, 463

See application file for complete search history.

(56) References Cited

U.S. PATENT DOCUMENTS

| | | | |
|---|---|---|---|
| 821,562 | A | 5/1906 | Wheeler |
| 837,892 | A | 12/1906 | Wheeler |
| 839,521 | A | 12/1906 | Spoerl |
| 843,781 | A | 2/1907 | Wheeler |
| 863,958 | A | 8/1907 | Wheeler |
| 940,933 | A | 11/1909 | Klein |
| 1,053,914 | A | 2/1913 | Hudson |
| 1,141,395 | A | 6/1915 | Johnson et al. |
| 1,219,238 | A | 3/1917 | Brown et al. |
| 1,228,835 | A | 6/1917 | Schuchart |
| 1,358,665 | A | 11/1920 | Wennerblad |
| 1,423,276 | A | 7/1922 | Straubel |
| 1,561,908 | A | 11/1925 | Cannard et al. |
| 1,566,079 | A | 12/1925 | Christman, Jr. et al. |
| 1,595,992 | A | 8/1926 | Cannard et al. |
| 1,713,016 | A | 5/1929 | Zuckerman |
| 1,761,517 | A | 6/1930 | Christman |

(Continued)

FOREIGN PATENT DOCUMENTS

| | | |
|---|---|---|
| AT | 219396 B | 1/1962 |
| DE | 372031 C | 3/1923 |

(Continued)

*Primary Examiner* — Nathaniel C Chukwurah
*Assistant Examiner* — Mobeen Ahmed
(74) *Attorney, Agent, or Firm* — Reinhart Boerner Van Deuren P.C.

(57) ABSTRACT

A web processing system is provided. The web processing system supplies a processed continuous web of material to a cutting arrangement. The cutting arrangement forms sheets from the continuous web of material. The sheets are then supplied to multiple folding arrangements such that a single web of material is used to supply sheets to multiple folding arrangements.

20 Claims, 8 Drawing Sheets

(56) References Cited

U.S. PATENT DOCUMENTS 1,871,301 A 8/1932 Campbell
1,886,312 A 11/1932 Stanton
1,966,885 A 7/1934 Crafts
1,974,149 A 9/1934 Christman
2,057,879 A 10/1936 Campbell
2,077,878 A 4/1937 Fairchild
2,092,952 A 9/1937 Campbell
2,171,619 A * 9/1939 Zuckerman ..... B41F 13/56 270/6
2,631,846 A 3/1953 Sabee
2,642,279 A 6/1953 Teall
2,809,082 A 10/1957 Marcuse
2,872,186 A 2/1959 Raybuck
2,929,624 A 3/1960 Brooker
3,034,780 A 5/1962 Stelling, Jr. et al.
3,150,871 A 9/1964 Boblit, Jr. et al.
3,163,413 A 12/1964 Franke et al.
3,178,171 A 4/1965 Springer
3,195,883 A 7/1965 Southwell et al.
3,211,448 A 10/1965 Stoothoff
3,279,792 A 10/1966 Kostal et al.
3,291,479 A 12/1966 Greiner et al.
3,301,111 A 1/1967 Nystrand
3,307,844 A 3/1967 Stults
3,314,340 A 4/1967 Bishop
3,338,575 A 8/1967 Nystrand et al.
3,351,215 A 11/1967 Kitch
3,363,896 A 1/1968 McKindary
3,401,928 A 9/1968 Frick
3,460,825 A 8/1969 Mets et al.
3,466,029 A 9/1969 Jensen et al.
3,489,406 A 1/1970 Nystrand
3,490,762 A 1/1970 Nystrand
3,514,047 A 5/1970 De Mallie et al.
3,521,878 A * 7/1970 Bolza-Schunemann ..... B41F 13/54 493/429
3,536,317 A 10/1970 Billett
3,540,723 A * 11/1970 Bolza-Schunemann ..... B41F 13/56 493/360
3,557,688 A 1/1971 Hartbauer et al.
3,572,681 A 3/1971 Nystrand
3,624,723 A 11/1971 Cannon
3,647,201 A 3/1972 Kemp
3,659,840 A 5/1972 Ruck
3,679,094 A 7/1972 Nissen et al.
3,679,095 A 7/1972 Nissen et al.
3,689,061 A 9/1972 Nystrand
3,709,077 A 1/1973 Trogan et al.
3,762,697 A 10/1973 Bolza-Schünemann
3,784,186 A 1/1974 Lenthall et al.
3,784,187 A * 1/1974 Takayanagi ..... B65H 45/168 270/42
3,784,188 A 1/1974 De Ligt
3,817,514 A 6/1974 Nissen et al.
3,834,689 A 9/1974 Lee et al.
3,841,620 A 10/1974 Lee et al.
3,841,621 A 10/1974 Brown
3,844,189 A 10/1974 Jardine
3,845,948 A 11/1974 Furbeck et al.
3,850,425 A 11/1974 Marcalus et al.
3,866,905 A 2/1975 Trogan et al.
3,869,095 A 3/1975 Diltz
3,947,013 A 3/1976 Nystrand
3,948,504 A 4/1976 Woessner et al.
3,972,486 A 8/1976 Stranjups
3,980,289 A 9/1976 Harm
3,980,291 A 9/1976 Loase
3,991,994 A 11/1976 Farish
4,000,863 A 1/1977 Stranjups
4,052,048 A 10/1977 Stirasaka
4,061,325 A 12/1977 Marcalus et al.
4,070,014 A 1/1978 Takahashi
4,085,927 A 4/1978 Müller
4,095,780 A 6/1978 Gaspar et al.
4,131,272 A 12/1978 Hartnig
4,163,548 A 8/1979 Nystrand
4,190,241 A 2/1980 Krueger
4,190,242 A 2/1980 Bolza-Schunemann
4,203,584 A 5/1980 Smaw
4,204,669 A 5/1980 Nystrand
4,205,836 A 6/1980 Nystrand
4,254,947 A 3/1981 Trogan
4,270,744 A 6/1981 Trogan
4,279,409 A 7/1981 Pemberton
4,279,410 A * 7/1981 Bolza-Schunemann ..... B41F 13/56 270/50
4,279,411 A 7/1981 Nystrand
4,283,973 A 8/1981 Spencer
4,285,621 A 8/1981 Spencer
4,290,592 A 9/1981 Kastner
4,325,475 A 4/1982 Spalding
4,328,655 A 5/1982 Spencer et al.
4,332,582 A 6/1982 Hertrich
4,332,583 A 6/1982 Stemmler et al.
4,349,185 A 9/1982 Small et al.
4,392,844 A 7/1983 Fulk et al.
4,396,336 A 8/1983 Malamood
4,403,981 A 9/1983 Wüthrich
4,406,650 A 9/1983 Felix
4,428,543 A 1/1984 Kuhn
4,453,706 A 6/1984 Bradley
4,471,955 A 9/1984 Bradley et al.
4,475,730 A 10/1984 Trogan
4,494,741 A 1/1985 Fischer et al.
4,504,051 A 3/1985 Bittner et al.
4,508,279 A 4/1985 Tokuno et al.
4,508,527 A 4/1985 Uno et al.
4,521,209 A 6/1985 DuFresne
4,530,694 A 7/1985 Köbler et al.
4,624,654 A 11/1986 Boyd et al.
4,625,957 A 12/1986 DuFresne
RE32,331 E 1/1987 Fulk et al.
4,650,447 A 3/1987 Meschi
4,666,139 A 5/1987 Filewich
4,673,382 A 6/1987 Buck et al.
4,691,908 A * 9/1987 Bradley ..... B65H 45/24 270/21.1
4,695,005 A 9/1987 Gietman, Jr.
4,700,939 A 10/1987 Hathaway
4,708,332 A 11/1987 Besemann
4,717,134 A 1/1988 Iida et al.
4,717,135 A 1/1988 Hathaway
4,718,654 A 1/1988 Ehlers
4,721,295 A 1/1988 Hathaway
4,723,390 A 2/1988 Duke
4,725,469 A 2/1988 Summerfield
4,751,807 A 6/1988 Couturier
4,765,604 A 8/1988 Trogan
4,770,402 A 9/1988 Couturier
4,776,649 A 10/1988 ten Wolde
4,778,165 A 10/1988 Buck
4,778,441 A 10/1988 Couturier
4,824,426 A 4/1989 DuFresne
4,826,095 A 5/1989 Wywialowski
4,842,574 A 6/1989 Noble et al.
4,854,932 A 8/1989 Schlottke et al.
4,861,326 A 8/1989 Kühner et al.
4,863,152 A 9/1989 Milo
4,874,158 A 10/1989 Retzloff
4,892,119 A 1/1990 Hugo et al.
4,914,997 A 4/1990 Belvederi
4,915,993 A 4/1990 Ten Wolde
4,917,665 A 4/1990 Couturier
4,919,027 A 4/1990 Littleton
4,932,599 A 6/1990 Doerfel
4,952,432 A 8/1990 Ten Wolde
4,962,897 A 10/1990 Bradley
4,988,051 A 1/1991 Welschlau et al.
5,000,729 A 3/1991 Yamauchi
5,005,816 A 4/1991 Stemmler et al.

(56) References Cited

U.S. PATENT DOCUMENTS 5,015,317 A 5/1991 Corey et al.
5,030,193 A 7/1991 Breton et al.
5,030,311 A 7/1991 Michal et al.
5,040,738 A 8/1991 Biagiotti
5,049,123 A 9/1991 Breton et al.
5,064,179 A 11/1991 Martin
5,067,698 A 11/1991 Stemmler
5,072,919 A 12/1991 Schneider et al.
5,088,707 A 2/1992 Stemmler
5,104,055 A 4/1992 Buxton
5,110,101 A 5/1992 Roth
5,137,225 A 8/1992 Biagiotti
5,147,273 A 9/1992 Rottmann et al.
5,150,848 A 9/1992 Consani
5,176,371 A 1/1993 Rau et al.
5,205,808 A 4/1993 Gebhardt
5,226,611 A 7/1993 Butterworth et al.
5,269,744 A 12/1993 Moll
5,299,793 A 4/1994 Couturier
5,310,398 A 5/1994 Yoneyama
5,348,527 A 9/1994 Beckwith
5,425,697 A 6/1995 Lanvin
5,487,718 A 1/1996 Staniszewski
5,492,588 A 2/1996 Weder et al.
5,520,603 A 5/1996 Bluthardt et al.
5,554,094 A 9/1996 Viens
5,702,341 A 12/1997 Keilhau
5,730,695 A 3/1998 Hauschild et al.
5,842,964 A 12/1998 Huber et al.
5,868,276 A 2/1999 Loppnow et al.
5,899,447 A 5/1999 Muckenfuhs
5,904,277 A 5/1999 Niedermeyer
5,956,926 A 9/1999 O'Connor et al.
5,966,905 A 10/1999 O'Connor et al.
5,980,444 A 11/1999 Dickhoff
5,989,174 A 11/1999 Patrizio
5,992,682 A 11/1999 Loppnow et al.
6,024,682 A 2/2000 Mandel et al.
6,024,685 A 2/2000 Kirsch
6,045,002 A 4/2000 Wierschke
6,090,467 A 7/2000 Yip
6,165,116 A 12/2000 White
6,168,848 B1 1/2001 Heath
6,206,817 B1 3/2001 Sette et al.
6,213,346 B1 4/2001 Skerrett et al.
6,213,927 B1 4/2001 DeMatteis et al.
6,228,014 B1 5/2001 DeMatteis et al.
6,235,156 B1 5/2001 Pullinen et al.
6,238,328 B1 5/2001 Loppnow et al.
6,245,198 B1 6/2001 Kinnunen et al.
6,261,415 B1 7/2001 Johansson et al.
6,274,000 B1 8/2001 Koivukunnas et al.
6,279,890 B1 * 8/2001 Tomczak ..... B41F 13/56 101/227
6,286,712 B1 9/2001 Craig et al.
6,296,601 B1 10/2001 Couturier
6,343,124 B1 1/2002 Munoz
6,402,132 B1 6/2002 Michaelis et al.
6,422,552 B1 7/2002 Chesno et al.
6,431,038 B2 8/2002 Couturier
6,440,053 B1 8/2002 Niedermeyer
6,446,961 B1 9/2002 Foret et al.
6,539,829 B1 4/2003 Kauppila et al.
6,588,739 B1 * 7/2003 Weis ..... B41F 13/54 270/41
6,599,228 B2 7/2003 Hailey et al.
6,602,177 B2 8/2003 Muir
6,623,833 B2 9/2003 Chan
6,656,102 B1 12/2003 Nagano
6,689,038 B2 2/2004 White
6,708,855 B2 3/2004 Wilson et al.
6,709,549 B2 3/2004 Berglund et al.
6,709,592 B2 3/2004 Van Groenestijn et al.
6,712,746 B1 3/2004 White
6,752,751 B2 6/2004 Jackson et al.
6,945,922 B2 9/2005 Baggot et al.
7,008,364 B2 3/2006 Ochsenbauer
7,060,016 B2 6/2006 Cipolli
7,081,080 B2 7/2006 Sosalla et al.
7,121,994 B2 10/2006 Haasl
7,146,777 B2 12/2006 Focke et al.
7,219,890 B2 5/2007 White
7,264,583 B2 9/2007 Gelli et al.
7,306,554 B2 12/2007 Couturier et al.
7,329,221 B2 2/2008 Haasl et al.
7,351,190 B2 4/2008 Brunow et al.
7,402,130 B1 7/2008 Sjostedt et al.
7,407,161 B2 8/2008 White
7,442,157 B2 10/2008 De Matteis
7,452,321 B2 11/2008 Kauppila
7,458,927 B2 12/2008 Kauppila et al.
7,472,802 B2 1/2009 van Riel
7,517,309 B2 4/2009 De Matteis
7,717,839 B2 5/2010 Butterworth
7,758,486 B2 7/2010 Ochsenbauer
7,771,337 B2 8/2010 White et al.
8,104,755 B2 * 1/2012 Dawley ..... B41F 13/58 270/5.02
8,123,665 B2 2/2012 De Matteis
2001/0014643 A1 8/2001 Sander
2004/0152577 A1 * 8/2004 Niedermeyer ..... B65H 45/28 493/428
2005/0073090 A1 4/2005 White
2005/0082332 A1 4/2005 White
2006/0052228 A1 3/2006 De Matteis
2006/0063567 A1 3/2006 St. Germain et al.
2006/0063657 A1 3/2006 St. Germain et al.
2007/0082260 A1 4/2007 Slivar
2007/0082800 A1 4/2007 Kauppila
2007/0082801 A1 4/2007 Kauppila et al.
2007/0144324 A1 * 6/2007 Robert ..... B65H 45/28 83/659
2007/0161487 A1 7/2007 Ryczek et al.
2007/0197365 A1 8/2007 De Matteis
2007/0203007 A1 8/2007 De Matteis
2007/0238596 A1 10/2007 Terhaag et al.
2008/0113855 A1 5/2008 Gooding, Jr.
2008/0200324 A1 8/2008 Morelli et al.
2009/0253564 A1 * 10/2009 Butterworth ..... B65H 45/24 493/357
2009/0289407 A1 11/2009 De Matteis
2009/0298661 A1 12/2009 Grill
2011/0140340 A1 * 6/2011 Spatz ..... B41G 7/006 270/58.08
2011/0201486 A1 8/2011 Cline et al.
2011/0230324 A1 9/2011 De Matteis
2011/0237415 A1 * 9/2011 Kojima ..... B65H 45/168 493/442
2012/0165174 A1 6/2012 Butterworth
2012/0190524 A1 7/2012 Butterworth et al.
2012/0202670 A1 8/2012 De Matteis
2013/0296153 A1 11/2013 Walsh et al.
2015/0360901 A1 12/2015 Butterworth

FOREIGN PATENT DOCUMENTS

DE 442935 C 4/1927
DE 719833 C 4/1942
DE 2 123 243 A1 11/1972
DE 4118097 A1 12/1992
EP 0 302 031 A2 2/1989
EP 0 376 754 A2 7/1990
EP 1 118 568 A2 7/2001
EP 1 371 593 A2 12/2003
EP 1 514 677 A1 3/2005
EP 1 520 822 A2 4/2005
EP 1 820 763 A1 8/2007
EP 1 826 165 A1 8/2007
GB 321873 11/1929
GB 1 479 299 A 7/1977
GB 2 084 965 A 4/1982
IT 646301 9/1962
JP S57160865 A 10/1982

(56) References Cited

FOREIGN PATENT DOCUMENTS

| | | | |
|---|---|---|---|
| JP | 58-220064 | A | 12/1983 |
| WO | WO 91/06890 | A2 | 5/1991 |
| WO | WO 94/21464 | A1 | 9/1994 |
| WO | WO 98/45197 | A1 | 10/1998 |
| WO | WO 98/45199 | A1 | 10/1998 |
| WO | WO 98/47709 | A1 | 10/1998 |
| WO | WO 98/47803 | A2 | 10/1998 |
| WO | WO 98/47804 | A2 | 10/1998 |
| WO | WO 2007/031971 | A2 | 3/2007 |
| WO | WO 2007/044701 | A2 | 4/2007 |
| WO | WO 2011/015893 | A1 | 2/2011 |

* cited by examiner

WEB PROCESSING SYSTEM WITH MULTIPLE FOLDING ARRANGEMENTS FED BY A SINGLE WEB HANDLING ARRANGEMENT

FIELD OF THE INVENTION

This invention generally relates to systems for folding or interfolding sheets of web like product, such as paper towels, napkins, facial tissues or the like.

BACKGROUND OF THE INVENTION

There are many products, as exemplified by paper tissue, toweling and napkins, etc., which are commonly provided to consumers in stacked form as packs of folded or interfolded individual sheets. These packs of stacked sheets are often staple items which must be produced at very low cost. Producing such products at low cost typically requires the use of systems that use high-speed processes and equipment.

These systems will typically convert one or more continuous webs of product that will be cut into sheets, folded or interfolded, separated into individual stacks, and then packaged. To reduce costs, it is important to maximize the efficiency of all equipment within the system such that all components are being operated at or near peak capacity.

Further, while these systems form a relatively small product, to provide large volume production the systems themselves are often very large. To further reduce cost, it is desirous to reduce the overall footprint of the system.

One portion of the system that can be run at very high speeds and that typically takes up a large footprint is the web feed arrangement that processes the continuous web of material and feeds it to a cutting arrangement. This system usually includes one or more rolls of web like product and devices for manipulating the web like product such as roll unwind stands, embossers, combiners, calendaring rolls, printing rolls, etc. Typically, this portion of the system does not limit the overall output of the system and is operated at less than peak capacity.

Additionally, it can be beneficial to produce stacks of folded sheets that have different characteristics. For instance, it could be desirable to form stacks of sheets that have different number of panels per folded sheet. For instance, it could be desired to form some stacks of sheets that have 3 panels while other stacks of sheets have 4 panels or 2 panels. Further, it could be desired to form small stacks having 25 sheets per stack and bulk stack that have 500 sheets, for example. Thus, flexibility in a system is also desirable.

The present invention provides improvements over the current state of the art that address one or more of these issues.

BRIEF SUMMARY OF THE INVENTION

In one embodiment, a new and improved web processing system is provided. The web processing system processes a processed continuous web of material into a plurality of folded sheets. The system includes a web handling arrangement, a cutting arrangement and first and second folding arrangements. The web handling arrangement supplies a processed continuous web of material to the cutting arrangement. The cutting arrangement cuts the processed continuous web of material into a stream of sheets. The first folding arrangement is downstream from the cutting arrangement and is configured to receive sheets from the cutting arrangement and form first folded sheets. The second folding arrangement is downstream from the cutting arrangement and is configured to receive sheets from the cutting arrangement and form second folded sheets.

It is therefore a feature the at the present system is configured such that a single web handling arrangement that a single processed continuous web of material can be used to supply material to multiple separate folding arrangements in the form of first sheets and second sheets formed from the single web of material. Thus, only a single web handling arrangement is required to feed material to multiple folding arrangements that can operate simultaneously.

In one embodiment, a first sheet path is defined between the cutting arrangement and the first folding arrangement. A first set of sheets of the stream of sheets travels along the first sheet path from the cutting arrangement to the first folding arrangement. A second sheet path is defined between the cutting arrangement and the second folding arrangement. A second set of sheets of the stream of sheets travels along the second sheet path from the cutting arrangement to the second folding arrangement.

In one embodiment, the first folding arrangement forms folded product of a first type and the second folding arrangement forms folded product of a second type. As such, the system could be configured to form both interfolded and non-interfolded sheets. The system could be configured to form folded sheets with different number of panels at the same time (e.g. one folded configuration would be formed from the first folding arrangement and a second folded configuration would be formed from the second folding arrangement).

In one embodiment, the first and second folding arrangements are interfolding arrangements.

In one embodiment, the first and second folding arrangements are non-interfolding arrangements.

In one embodiment, the cutting arrangement includes a knife roll. The first folding arrangement includes counter-rotating first and second folding rolls. The second folding arrangement includes counter-rotating first and second folding rolls. The system further includes first and second lap rolls. The first lap roll is operably positioned between the knife roll and the first folding roll of the first folding arrangement. The second lap roll is operably positioned between the knife roll and the first folding roll of the second folding arrangement.

In one embodiment, the system further includes a transfer roll positioned between the knife roll and the second lap roll. A first set of sheets from the stream of sheets travels from the knife roll to the first folding roll of the first folding arrangement by passing from the knife roll to the first lap roll and then from the first lap roll to the first folding roll of the first folding arrangement. A second set of sheets from the stream of sheets travels from the knife roll to the first folding roll of the second folding arrangement by passing from the knife roll to the transfer roll, from the transfer roll to the second lap roll and then from the second lap roll to the first folding roll of the second folding arrangement.

In one embodiment, the knife roll rotates at a first surface speed, the first and second lap rolls rotate at a second surface speed being slower than the first surface speed and the first folding rolls of the first and second folding arrangements rotate at a third surface speed being slower than the second surface speed.

In one embodiment, the cutting arrangement directly transfers sheets from the knife roll to the first and second lap rolls. In this embodiment, a transfer roll is not provided and allows the sheets passing through the first folding arrangement and the sheets passing through the second folding arrangement to have outer surfaces of the sheets in the same orientation as they pass through either folding arrangement.

In one embodiment, the first set of sheets and second set of sheets are formed by alternating sheets formed by the cutting arrangement from the processed continuous web of material.

In one embodiment, the system further includes first and second separators. The first separator is downstream from the first folding arrangement and forms first stacks from the first folded sheets. A second separator downstream from the second folding arrangement forms second stacks from the first folded sheets. A single conveying system receives the first and second stacks and carries the first and second stacks away from the first and second folding arrangements.

In a further embodiment, a method of processing a processed continuous web of material into folded sheets is provided. The method includes supplying, with a web handling arrangement, a processed continuous web of material to a cutting arrangement. The method includes cutting, with the cutting arrangement, the processed continuous web of material into a stream of sheets. The method includes receiving, by a first folding arrangement downstream from the cutting arrangement, sheets formed from the cutting arrangement. The method includes receiving, by a second folding arrangement downstream from the cutting arrangement, sheets formed from the cutting arrangement.

In an embodiment, a first sheet path is defined between the cutting arrangement and the first folding arrangement. A second sheet path is defined between the cutting arrangement and the second folding arrangement. The method further includes directing a first set of sheets of the stream of sheets along the first sheet path from the cutting arrangement to the first folding arrangement, and directing a second set of sheets of the stream of sheets along the second sheet path from the cutting arrangement to the second folding arrangement.

In an embodiment, the method includes forming, with the first folding arrangement, folded sheets of a first type and forming, with the second folding arrangement, folded sheets of a second type.

In an embodiment, the method includes interfolding, with the first folding arrangement, the first set of sheets and interfolding, with the second folding arrangement, the second set of sheets.

In an embodiment, the method includes non-interfolding, with the first folding arrangement, the first set of sheets and non-interfolding, with the second folding arrangement, the second set of sheets.

In an embodiment, the cutting arrangement includes a knife roll; the first folding arrangement includes counter-rotating first and second folding rolls; the second folding arrangement includes counter-rotating first and second folding rolls. A first lap roll is operably positioned between the knife roll and the first folding roll of the first folding arrangement. The second lap roll is operably positioned between the knife roll and the first folding roll of the second folding arrangement.

In an embodiment, a transfer roll is positioned between the knife roll and the second lap roll. A first set of sheets from the stream of sheets travels from the knife roll to the first folding roll of the first folding arrangement by passing from the knife roll to the first lap roll and then from the first lap roll to the first folding roll of the first folding arrangement. A second set of sheets from the stream of sheets travels from the knife to the roll first folding roll of the second folding arrangement by passing from the knife roll to the transfer roll, from the transfer roll to the second lap roll and then from the second lap roll to the first folding roll of the second folding arrangement.

In an embodiment, the method includes rotating the knife roll at a first surface speed; rotating the first and second lap rolls at a second surface speed being slower than the first surface speed; and rotating the first folding rolls of the first and second folding arrangements at a third surface speed being slower than the second surface speed.

In an embodiment, the first and second folding arrangements are interfolding folding arrangements for interfolding the sheets.

In an embodiment, the sheets are directly transferred from the knife roll to the first and second lap rolls.

In an embodiment, a first sheet path is defined between the cutting arrangement and the first folding arrangement. A second sheet path is defined between the cutting arrangement and the second folding arrangement. The method includes directing a first set of sheets of the stream of sheets along the first sheet path from the cutting arrangement to the first folding arrangement. The method includes directing a second set of sheets of the stream of sheets travels along the second sheet path from the cutting arrangement to the second folding arrangement.

In an embodiment, the first set of sheets and second set of sheets are formed by alternating sheets formed by the cutting arrangement from the processed continuous web of material, the first set of sheets being formed by every odd sheet and the second set of sheets being formed by every even sheet, the method including sending every odd sheet down the first sheet path and every even sheet down the second sheet path.

In an embodiment, the method includes forming, with the first folding arrangement, first folded product from the first set of sheets; forming, with the second folding arrangement, second folded product from the second set of sheets; separating the first folded product into first sacks with a first separator downstream from the first folding arrangement; separating the second folded product into first sacks with a second separator downstream from the second folding arrangement; and conveying, with a conveying system, the first and second stacks away from the first and second folding arrangements.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
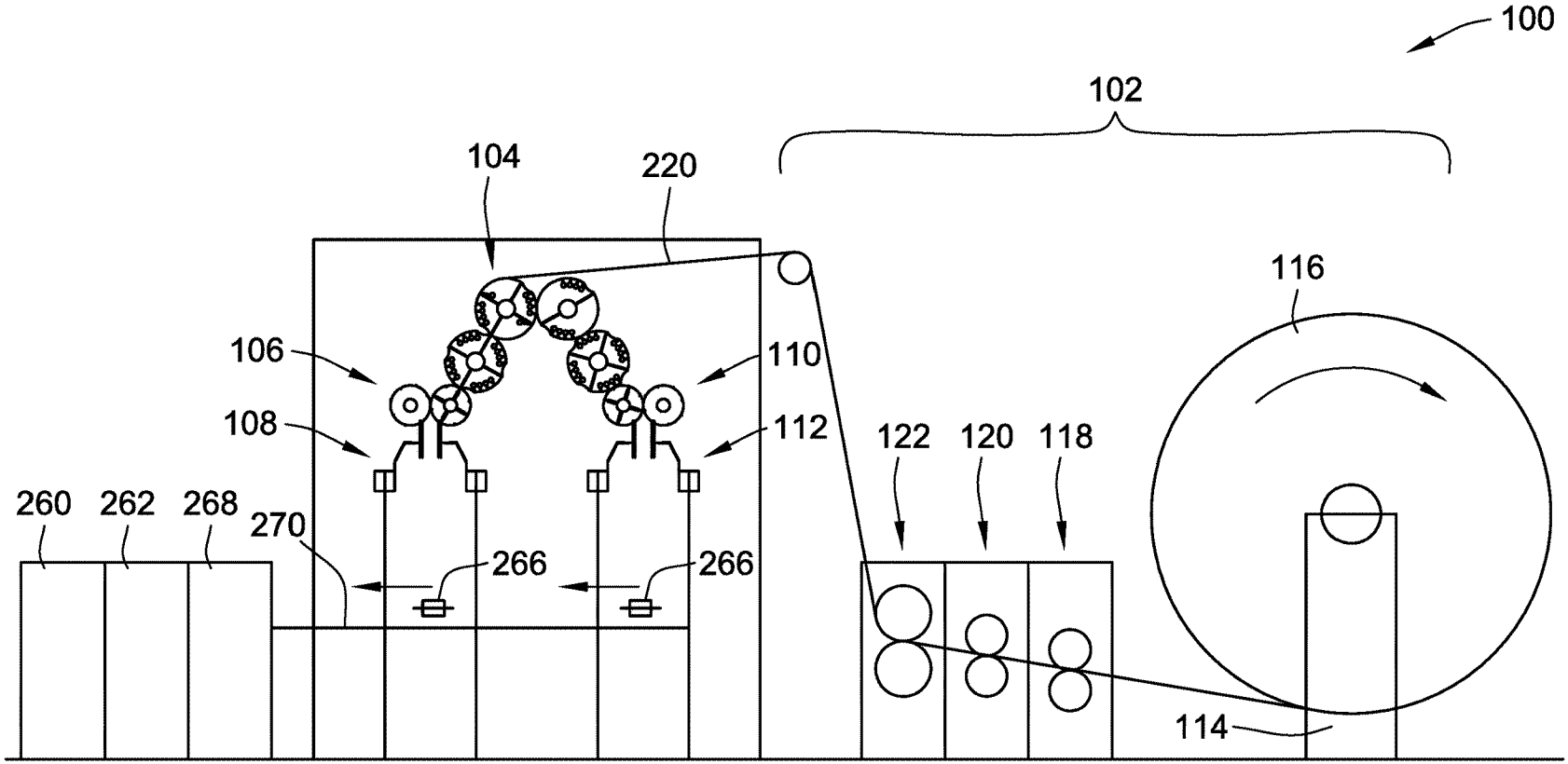
FIG. 1 is a simplified schematic illustration of a web processing system according to an embodiment of the invention.

FIG. 1 is a schematic illustration of an embodiment of a web processing system 100 used to form stacks of folded sheets from a web-like product. The folded sheets may be interfolded where each folded sheet has individual panels inserted between panels of upstream and downstream folded sheets or simply stacked (also referred to as "non-interfolded") where folded sheets do not have panels inserted between upstream and downstream folded sheets.

The system is designed to maximize the capacity of the web handling arrangement 102 that handles and processes the web-like product in its continuous form prior to being cut into individual sheets. The web handling arrangement 102 supplies the continuous web of material to a cutting arrangement 104, which will form individual sheets of web-like product. The individual sheets of web-like product are then separated into multiple individual streams of sheets. A first stream of sheets is operably arranged and sent to a first folding arrangement 106 where the sheets of the first stream of sheets are operably folded (e.g. interfolded or non-interfolded) and form a first continuous stack of folded sheets. The first continuous stack of folded sheets is then separated into first individual stacks by a first separator 108. A second stream of sheets is operably arranged and sent to a second folding arrangement 110 where the sheets of the second stream of sheets are operably folded (e.g. interfolded or non-interfolded) and form a second continuous stack of folded sheets. The second continuous stack of folded sheets is then separated into second individual stacks by a second separator 112.

The present invention provides a significant improvement over the current state of the art by providing a single web handling arrangement 102 to supply a processed continuous web of material to a single cutting arrangement 104 for feeding multiple folding arrangements. Typically, the speed at which folded sheets can be formed is limited by the speed at which the sheets can be folded (e.g. interfolded or non-interfolded). By feeding multiple folding arrangements with a single web handling arrangement 102, the web handling arrangement 102 can be operated at a higher capacity while reducing overall floor space required for two separate folding arrangements. Typically, each folding arrangement would have one or two dedicated web handling arrangements upstream of the corresponding cutting arrangement 104. However, each of those dedicated web handling arrangements would be operated at less than maximum capacity due to the speed limitations of the downstream folding arrangement.

In FIG. 1, the web handling arrangement 102 is illustrated in schematic form. The web handling arrangement 102 supplies a single, processed continuous web of material to the cutting arrangement 104. In the illustrated embodiment, the web handling arrangement includes an unwind stand 114 that holds a continuous roll of web-like material 116 (also referred to as "roll 116"). The unwind stand can include devices for changing the roll when the roll is spent, devices for controlling the unwind speed, as well as devices for controlling the tension of the continuous web of material as it is being dispensed from the roll 116 as it travels through the web handling arrangement 102.

The illustrated web handling arrangement 102 also includes several finishing units for manipulating the web-like material after it is unwound from the roll 116 and prior to supplying a processed continuous web of material to the cutting arrangement 104. As used herein "processed continuous web of material" shall mean the continuous web of material that is supplied to the cutting arrangement, which may or may not have been actually manipulated by any finishing units after it is unwound from roll 116.

In FIG. 1, these finishing units are shown schematically and are generally used to change characteristics of the web of material such as texture, pattern, surface finishing, coloring, to remove raw edges, etc. The finishing units may also be used to better align the web of material as it is fed to the cutting arrangement 104. A few units are illustrated schematically in FIG. 1 and include a calendaring unit 118, a printing unit 120 and an embossing unit 122. These units will include rolls or other devices for manipulating the continuous web of material that is unwound from roll 116 to manipulate the continuous web of material. Other finishing units may be included as well such as a combining unit. Further, the particular order of the units is for illustrative purposes and the units could be reordered. Further, less or even no finishing units could be used in other embodiments.

Further, some web processing systems according to the invention could form sheets formed from multiple plies of web-like product. However, the multiple plies may be provided by roll 116 or multiple continuous webs of material could be combined by the web handling arrangement and supplied to the cutting arrangement 104 as the processed continuous web of material. In such an embodiment, each ply may be individually processed by one or more finishing units. Further, once the individual plies have been combined, the combined multiply ply web of material could be processed by one or more finishing units. As such, a multiple ply web handling arrangement shall be considered as a single web handling arrangement if it ultimately forms a single processed continuous web of material.

Figure 2:
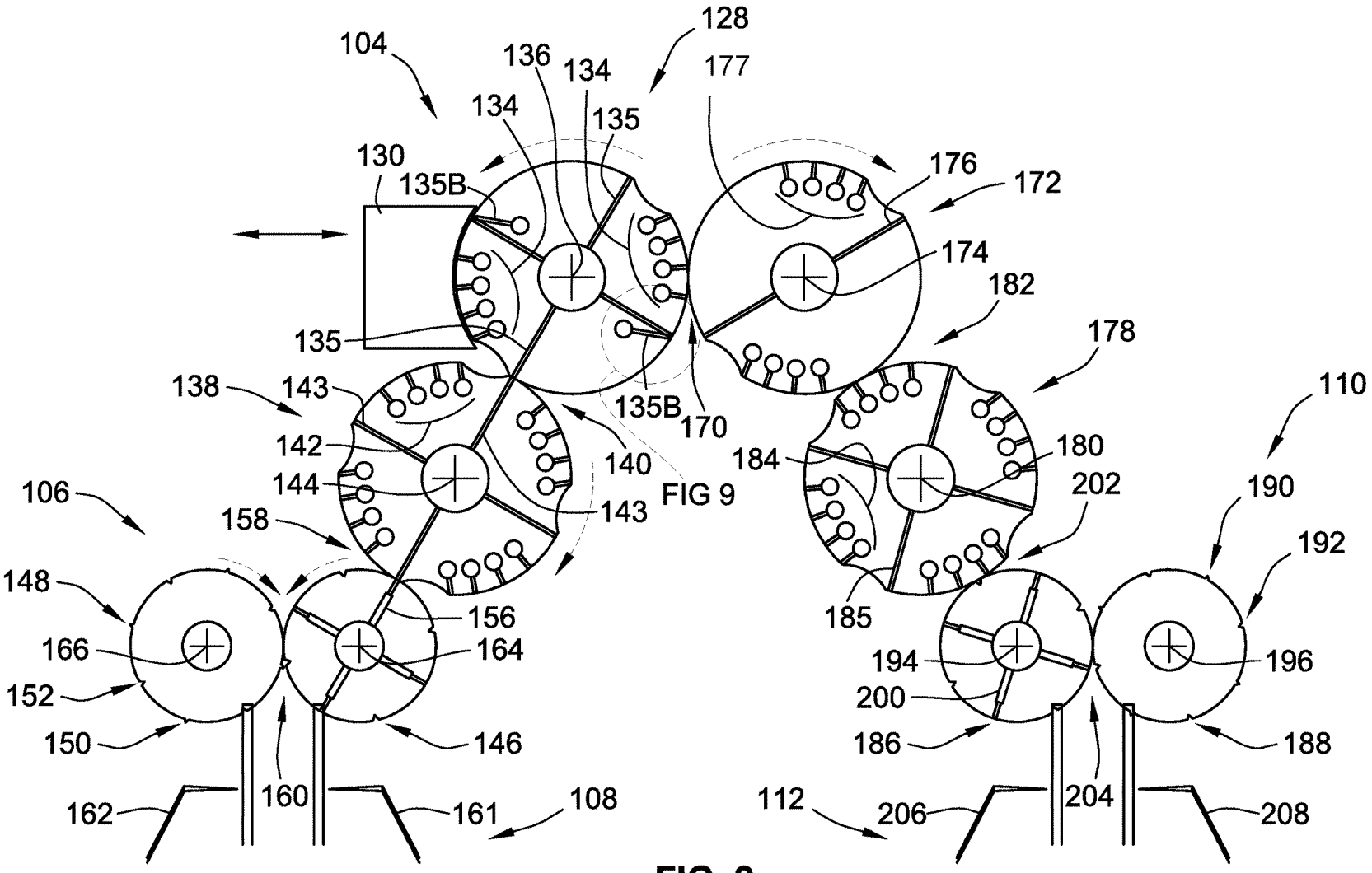
FIG. 2 is an enlarged simplified illustration of the cutting arrangement and folding arrangements of the system of FIG. 1.

FIG. 2 is an enlarged schematic illustration of components of the web processing system 100 downstream from the web handling arrangement 102. Cutting arrangement 104 is illustrated. The schematic illustration of the cutting arrangement 104 includes a knife roll 128 and an anvil 130. With reference to enlarged FIG. 9, the knife roll 128 includes one or more knife blades 132 that operably cooperate with the anvil 130 to sever a processed continuous web of material into a plurality of consecutive sheets. The anvil 130 could be stationary or could reciprocate radially toward and away from the knife roll 128 to effectuate a cut. Alternatively/additionally, the knife blades 132 could be movable radially to effectuate a cut. While one cutting arrangement is illustrated other mechanisms for effectuating a cut could be incorporated.

Figure 9:
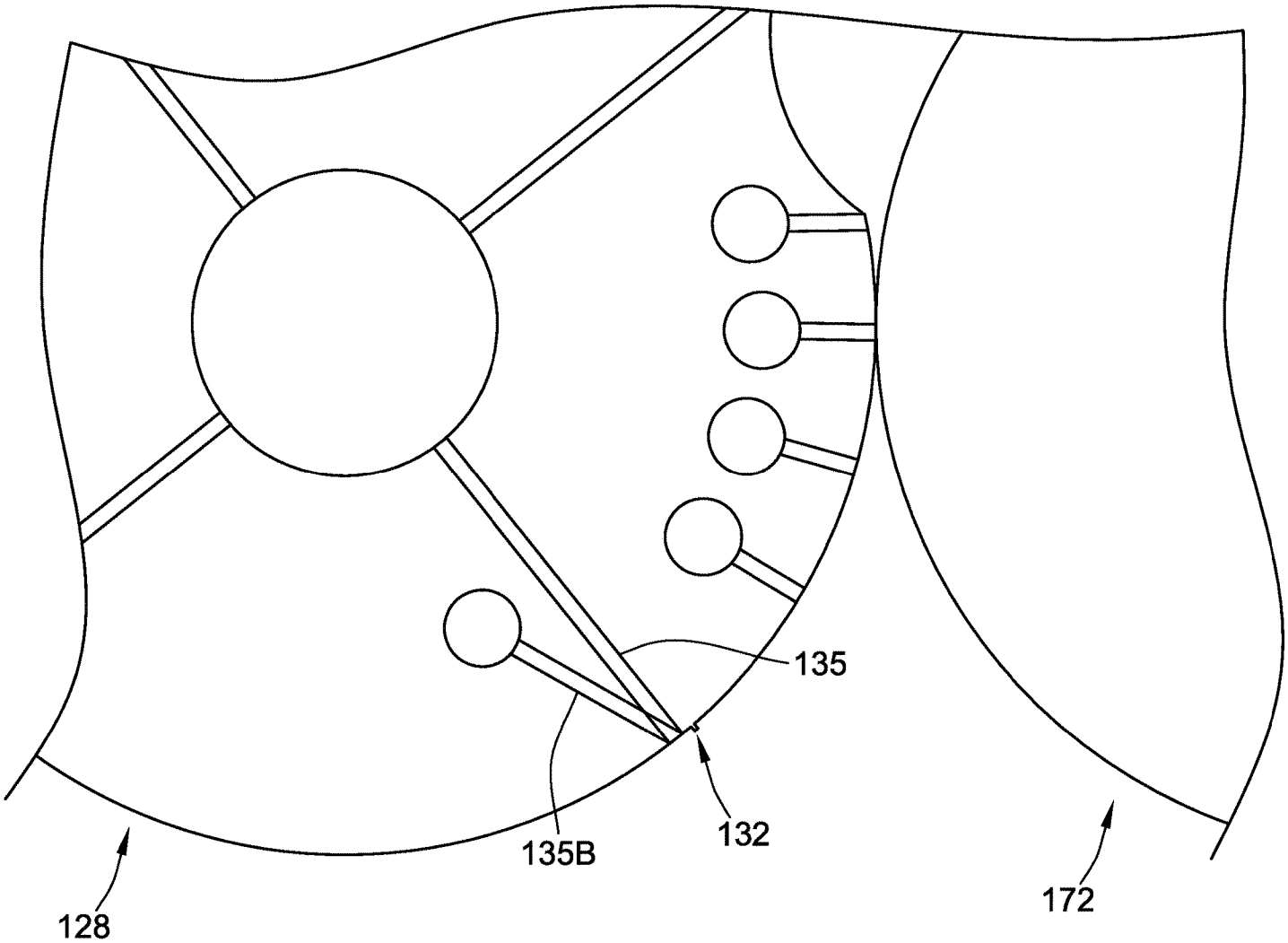
FIG. 9 is an enlarge illustration of a portion of the knife roll of FIG. 2 illustrating the knife blade thereof.

The knife roll 128 includes a plurality of knife roll vacuum ports 134, 135 that are used to operably hold the processed continuous web of material and the cut sheets of material to the knife roll 128 and particularly an outer periphery thereof after being severed from the processed continuous web of material. The knife blades 132 will be located adjacent knife roll vacuum ports 135 as knife roll vacuum ports 135 are used to hold a lead end of sheets when they are cut from the processed continuous web of material. As illustrated in FIGS. 2 and 9, knife roll vacuum port 135 may have two separate ports for holding the leading end of a sheet after it has been cut from the processed continuous web of material. The secondary knife roll vacuum port 135B (see FIG. 1 and FIG. 9) is used to hold the lead end of sheets that are carried past the first lap roll 138 to transfer roll 172 as will be discussed in more detail below.

The knife roll 128 generally rotates about rotational axis 136.

Downstream from the knife roll 128 is a first lap roll 138. The first lap roll 138 and knife roll 128 form a nip 140 therebetween. Cut sheets, and particularly the leading end thereof, may be transferred between the knife roll 128 and the first lap roll 138 at nip 140. The first lap roll 138 includes in a plurality of first lap roll vacuum ports 142, 143 that are used to transfer selected cut sheets from the knife roll 128 to the first lap roll 138.

The first lap roll 138 rotates about rotational axis 144.

Sheets that are transferred from the knife roll 128 to the first lap roll 138 are ultimately directed to first folding arrangement 106. The first folding arrangement 106 includes counter-rotating first and second folding rolls 146, 148 that are configured to fold the cut sheets. The first and second folding rolls 146, 148 include tuckers and grippers 150, 152 that operatively align with grippers and tuckers 152, 150 of the other one of the first and second folding rolls 146, 148 to effectuate the folds in the sheets. The tuckers and grippers 150, 152 are illustrated schematically as a projection and a groove, respectively. However, the tuckers and grippers 150, 152 could take any form such as for example mechanical grippers and mechanical tuckers. Further, the gripper could be in the form of a vacuum gripper.

The first and second folding rolls 146, 148 rotate about rotational axes 164, 166.

The first folding roll 146 includes one or more vacuum ports 156 for operably transferring cut sheets from the first lap roll 138 to the first folding roll 146 at nip 158 formed between the first folding roll 146 and lap roll 138.

As the sheets pass through first folding nip 160 formed between the first and second folding rolls 146, 148, the sheets will be folded and form a continuously forming stack of folded sheets on a downstream side of first folding nip 160. The first separator 108 will separate the continuously forming stack of folded sheets into individual stacks. The first separator 108 is illustrated schematically and may include a plurality of fingers 161, 162 that are selectively inserted into the continuously building stack of sheets to form the separation, also referred to as "making the count" and form the individual stacks with a predetermined number of sheets.

The first lap roll 138 and first folding arrangement 106 define a first sheet path along which cut sheets travel from the knife roll 128 until they are ultimately folded.

Downstream from nip 140, the knife roll 128 defines a second nip 170 with transfer roll 172. Transfer roll 172 rotates about rotational axis 174. Selected sheets cut from the processed continuous web of material are transferred from the knife roll 128 to the transfer roll 172. The transfer roll 172 includes a plurality of vacuum ports 176, 177 for selectively transferring sheets from knife roll 128 to the transfer roll 172 and to hold the sheets to the outer periphery of the transfer roll 172.

A second lap roll 178 rotates about rotational axis 180. The transfer roll 172 and second lap roll 178 form a nip 182 therebetween where sheets are transferred therebetween. The second lap roll 178 is similar to first lap roll 138 and includes second lap roll vacuum ports 184, 185 for holding sheets to the outer periphery of the of second lap roll 178 and to transfer sheets from the transfer roll 172 to the second lap roll 178 at nip 182.

Sheets that are transferred from the knife roll 128 to transfer roll 172 are ultimately directed to second folding arrangement 110. The second folding arrangement 110 includes counter-rotating first and second folding rolls 186, 188 that are configured to fold the cut sheets. The first and second folding rolls 186, 188 include tuckers and grippers 190, 192 that operatively align with grippers and tuckers 192, 190 of the other one of the first and second folding rolls 186, 188 to effectuate the folds in the sheets. The tuckers and grippers 190, 192 are illustrated schematically as a projection and a groove, respectively. However, the tuckers and grippers 190, 192 could take any form such as for example mechanical grippers and mechanical tuckers. Further, the gripper could be in the form of a vacuum gripper.

The first and second folding rolls 186, 188 rotate about rotational axes 194, 196.

The first folding roll 186 includes one or more vacuum ports 200 for operably transferring cut sheets from the second lap roll 172 to the first folding roll 186 at nip 202 formed between the first folding roll 186 and second lap roll 178.

As the sheets pass through second folding nip 204 formed between the first and second folding rolls 186, 188, the sheets will be folded and form a continuously forming stack of folded sheets on a downstream side of first folding nip 204. The second separator 112 will separate the continuously forming stack of folded sheets into individual stacks. The second separator 112 is illustrated schematically and may include a plurality of fingers 206, 208 that are selectively inserted into the continuously building stack of sheets to form the separation, also referred to as "making the count" and form the individual stacks with a predetermined number of sheets.

The transfer roll 172, second lap roll 178 and second folding arrangement 110 define a second sheet path along which cut sheets travel from the knife roll 128 until they are ultimately folded.

Figure 5:
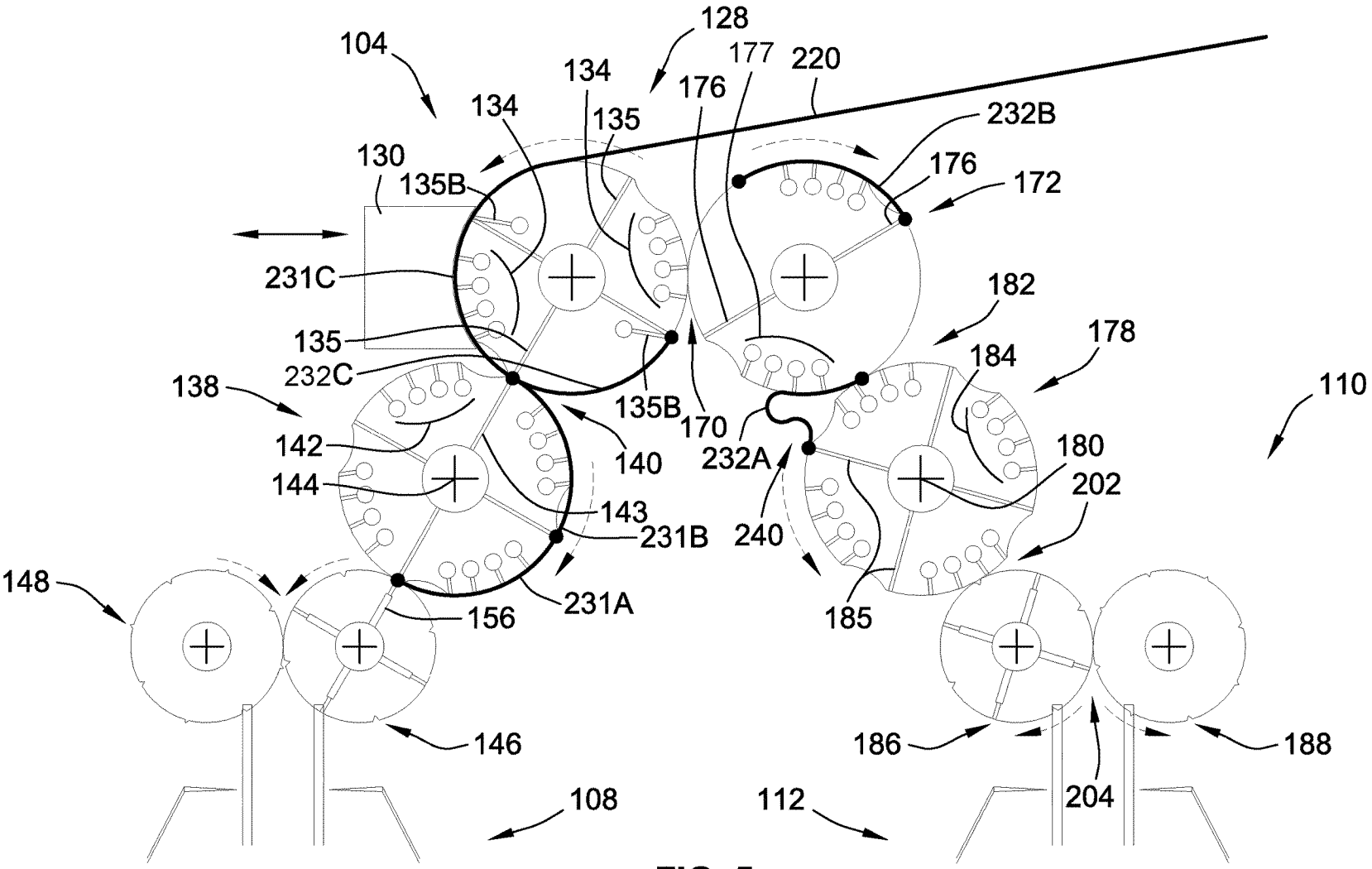
FIG. 5 is a simplified illustration of the cutting arrangement of the system of FIG. 1.
Figure 6:
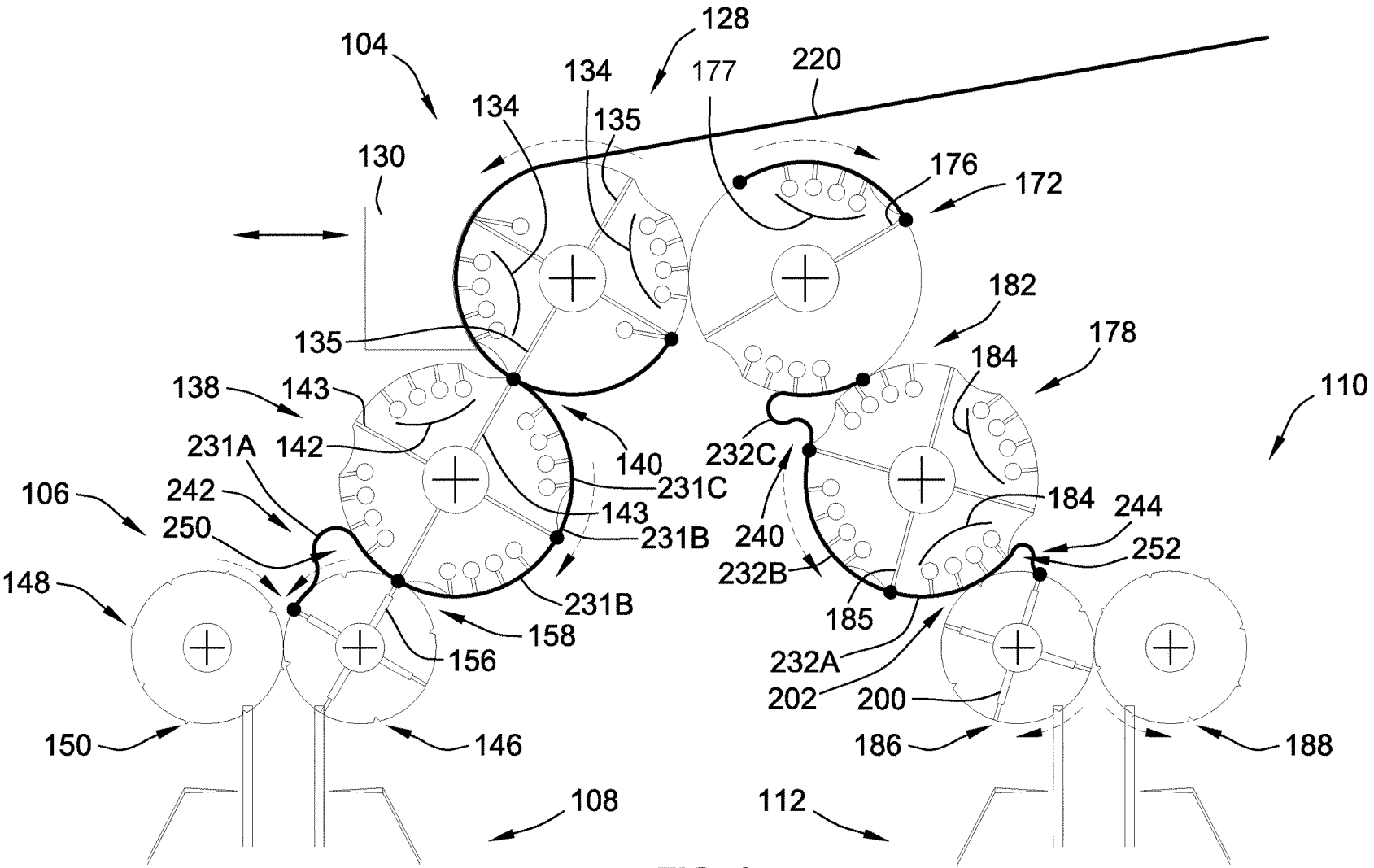
FIG. 6 is a simplified illustration of the folding arrangements of the system of FIG. 1.

It should be noted that each of the rolls, rotate about their corresponding rotational axes in the direction illustrated by the adjacent arrows (see e.g. FIGS. 5 and 6).

While FIG. 2 illustrates one embodiment of the web processing system, other embodiments could implement different configurations between the knife roll and the plurality of folding arrangements. For instance, it is contemplated that more or less components may be interposed between the knife roll and the plurality of folding arrangements.

It is contemplated that the first and second folding arrangements 106, 110 and components cooperating therewith can be configured to form multiple different types of products including both interfolded and non-interfolded sheets. Further, the system can be configured such that the first folding arrangement 106 forms a first type of product and the second folding arrangement 110 forms a second type of product as well as stacks of different numbers. It is contemplated that the folding arrangements 106, 110 can form 3 panel multifold, interfolded product; 4 panel multifold, interfolded product; 2 panel single fold, interfolded product, or combinations thereof.

Figure 4:
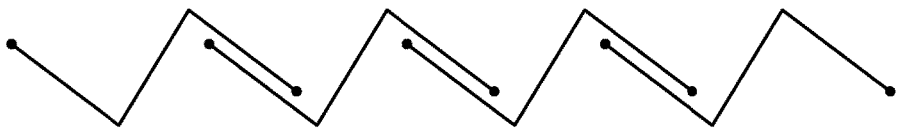
FIG. 4 is a simplified illustration of the folded product formed from the orientation shown in FIG. 3.
Figure 3:
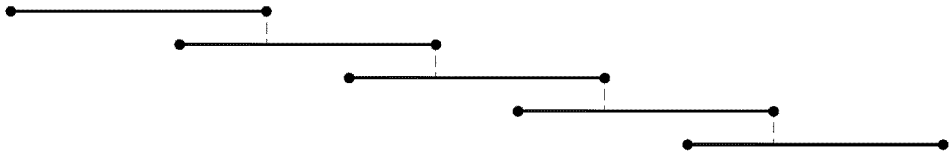
FIG. 3 is a simplified illustration of the orientation of the sheets for forming one form of a folded product.

In one implementation, the first and second interfolder arrangements are configured to form 3-panel multifold, interfolded products. To form 3-panel, interfolded products, sheets must be supplied to the folding arrangements in a shingled orientation as illustrated in FIG. 3. After the sheets pass through the interfolder in the orientation shown in FIG. 3, the sheets will be interfolded as illustrated in FIG. 4, schematically, with at least one panel of each sheet inserted between adjacent panels of an upstream and a downstream sheet.

With this background, operation of the web processing system 100 will be described. The following description will describe one implementation of the web processing system 100 where both the first and second interfolding arrangements 106, 110 will be operation and every other sheet that is cut from the processed continuous web of material is directed to either the first interfolding arrangement 106 or to the second interfolding arrangement 110. For instance, every odd sheet is directed toward the first interfolding arrangement 106 and every even sheet is directed toward the second interfolding arrangement 110. As such, each odd sheet can be considered to be a first set of sheets and each even sheet can be considered to be a second set of sheets.

First, the web process system 100 is designed to use a single web handling arrangement 102 (see FIG. 1) to supply web like material to two separate interfolding arrangements. Typically, the web like material is manipulated prior to being severed into individual sheets as described previously. As such, the web like material that is severed into individual sheets is referred to herein as processed continuous web of material for convenience.

With reference to FIG. 5, a single processed continuous web of material 220 is supplied to cutting arrangement 104 by the web handling arrangement 102 (see e.g. FIG. 1). The processed continuous web of material 220 is operably secured to the outer periphery of knife roll 128 by vacuum ports 134, 135.

In FIG. 5, numerous sheets have already been formed by the cutting arrangement 104 and have passed downstream from the anvil 130. In this illustration, first sheets represented generically by reference number 231 (e.g. odd sheets) are directed toward the first folding arrangement 106 while second sheets represented generically by reference number 232 (e.g. even sheets) are directed toward the second folding arrangement 110. The terms "first" and "second" as used herein are simply used to identify different devices. As such, the reference to "second" does not mean that two are required.

In this embodiment, the surface speed of the first lap roll 138 is half of the surface speed of the knife roll 128. The 2:1 surface speed difference between the knife roll 128 and the first lap roll 138 allows the first set of sheets to be aligned in an end to orientation on the outer surface of the first lap roll 138. This 2:1 surface speed difference allows removal of the gap between first sheet 231A and first sheet 231B left by second sheet 232B being directed toward the second folding arrangement 110.

Further, as the vacuum ports 135 of the knife roll 128 and vacuum ports 143 of the first lap roll 138 pass through nip transfer of the leading end of the first sheets 231 are transferred from the knife roll 128 to the lap roll 138 by operably turning off and on vacuum to vacuum ports 135, 143.

As also illustrated in FIG. 5, the second sheets 232 remain controlled by the knife roll 128 longer and are carried to nip 170 until vacuum ports 135B and 176 align to transfer the leading end of the second sheets 232 from the knife roll 128 to the transfer roll 172 by operably turning off and on vacuum to vacuum ports 135B and 176.

In this embodiment, there is no surface speed difference between the knife roll 128 and the transfer roll 172. As such, it can be seen that there is a gap between adjacent sheets 232A and 232B and particularly between the trailing end of sheet 232A and the leading end of sheet 232B due to sheet 231A being directed toward the first folding arrangement 106.

In this embodiment, the interface between the transfer roll 172 and the second lap roll 178 is similar to the interface between the knife roll 128 and the first lap roll 138. More particularly, the surface speed of the second lap roll 178 is half of the surface speed of the transfer roll 172. The 2:1 surface speed difference between the transfer roll 172 and the second lap roll 178 allows the second set of sheets to be aligned in an end to orientation on the outer surface of the second lap roll 178 (similar to that illustrated for the first lap roll 138). This 2:1 surface speed difference allows removal of the gap between second sheet 232A and second sheet 232B left by first sheet 231A being directed toward the first folding arrangement 106.

As illustrated in FIG. 5, due to the surface speed difference between transfer roll 172 and second lap roll 178, a bubble 240 is formed in the second sheets 232 (232A in FIG. 5) as they are transferred from the transfer roll 172 to the second lap roll 178 at nip 182. This occurs in part as the leading end of the second sheet 232 (232A in FIG. 5) is held by vacuum port 185 of the second lap roll 178 while an upstream trailing portion of the second sheet 232 (232A in FIG. 5) is held by vacuum ports 177 as these vacuum ports 177 pass through nip 182. Further, as vacuum ports 184 pass through nip 182 vacuum is typically not supplied to these ports 184 to prevent that portion of the second sheet from prematurely being removed from the transfer roll 172. Once the second sheet 232 completely and sufficiently passed through nip 182, vacuum to all of the vacuum ports of the transfer roll 172 holding the second sheet 232 can be turned off and vacuum to vacuum ports 184 of the second lap roll 178 can be turned on to help hold the second sheet to the outer periphery of the second lap roll 178.

With reference to FIG. 6, to obtain the shingled relationship illustrated in FIG. 3 for adjacent sheets of a given set of sheets, a surface speed difference occurs between the first lap roll 138 and the first folding roll 146 of the first folding arrangement 106 as well as between the second lap roll 178 and first folding roll 186 of the second folding arrangement 110. In this embodiment, the surface speed of the first folding rolls 146, 186 is ⅔ of the surface speed of the corresponding first and second lap rolls 138, 178 which results in a ⅓ overlap between adjacent sheets.

This surface speed difference results in bubble 242 to be formed as the first sheets 231 (231A in FIG. 6) are transferred from the first lap roll 138 to the first folding roll 146 and similar and bubble 244 to be formed as the second sheets 232 (232A in FIG. 6) are transferred from the second lap roll 178 to the first folding roll 186 of the second folding arrangement 110.

The leading end of the first sheets 231 are transferred from the first lap roll 138 to the first folding roll 146 at nip 158 when vacuum ports 156 align with vacuum ports 143. Similarly, the leading end of the second sheets 232 are transferred from the second lap roll 178 to the first folding roll 186 at nip 202 when vacuum ports 200 align with vacuum ports 185. The tail end portion of the sheets 231, 232 are held by vacuum ports 142, 184 until the tail end of the sheets 231, 232 has sufficiently passed through nips 140, 202.

Figure 7:
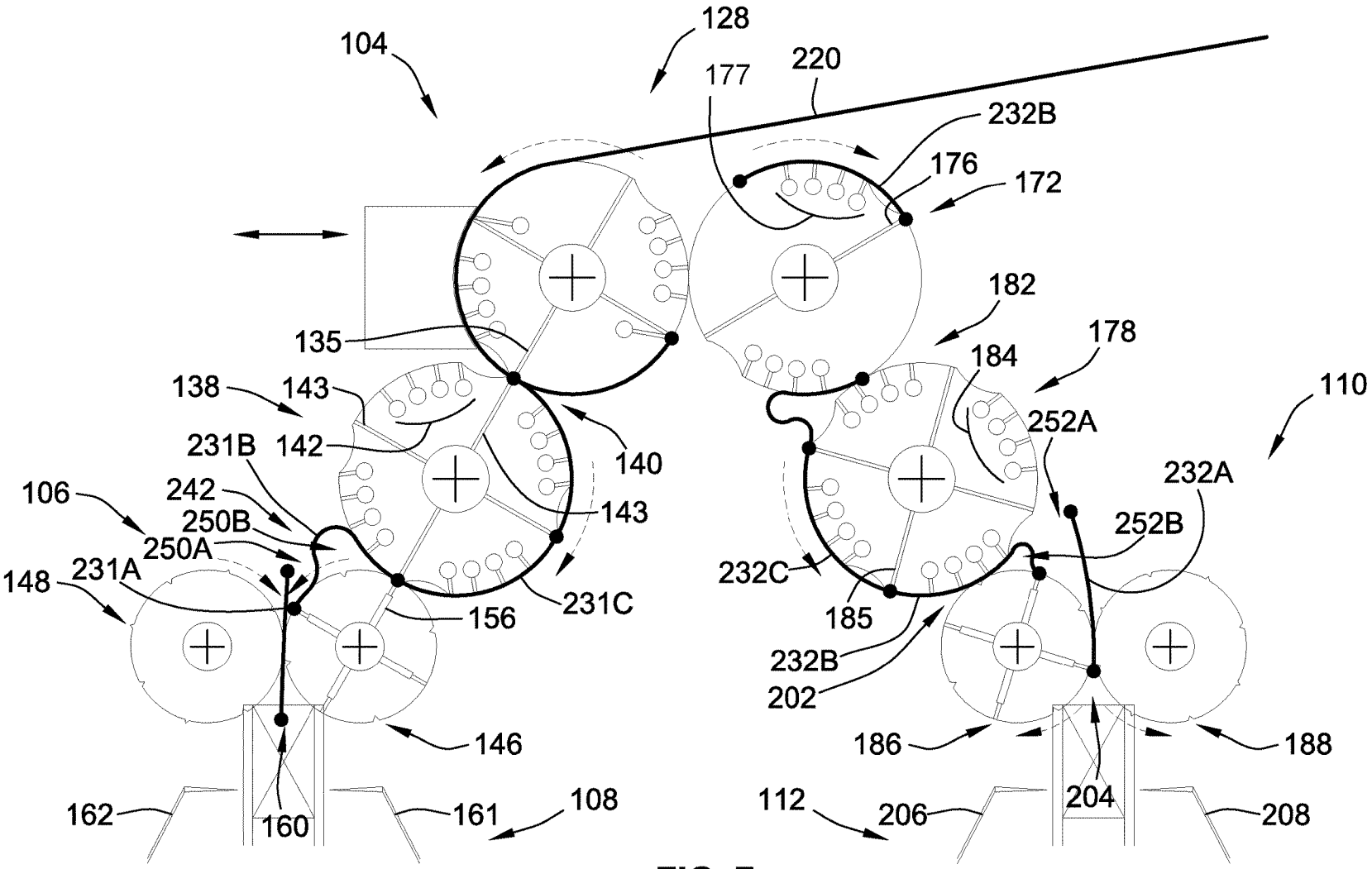
FIG. 7 is a further simplified illustration of the cutting arrangement and folding arrangements of the system of FIG. 1.

Further, as the tail end of the sheets 231, 232 (sheets 231A, 232A in FIG. 6) are lifted away from the first folding rolls 146, 186 the lead end of the next upstream sheet 231, 232 (sheets 231B, 232B) are transferred to the first folding rolls 146, 186 and within the gaps 250, 252 formed by the bubbles 242, 244 to effectuate the requisite overlap. These gaps and the overlap is additionally illustrated in FIG. 7.

Thus, the first and second lap rolls 138, 178 provide separate individual streams of sheets to their corresponding folding arrangements 106, 110 which are produced from a single upstream processed continuous web of material.

Once the sheets 231, 232 have been properly transfer to the corresponding folding arrangements 106, 110, as the overlapped sheets pass therethrough, the sheets 231, 232 will be folded and interfolded to form 3-panel, multifold, interfolded product as illustrated, schematically, in FIG. 4. A continuous stream of this interfolded product will be dispensed form the interfolding arrangements 106, 110. These continuous streams can be separated into individual stacks of interfolded sheets to form individual packs of sheets. The separators 108, 112 can perform these separations. While mechanical separators are provided, in alternative implementations, manual separation of stacks can be performed.

Typically, the interfolded sheets exiting the folding arrangements 106, 110 have a length parallel to the folds thereof that is large such that the sheets must be cut into several sections referred to as "clips". This cutting is performed using a log saw 260, illustrated schematically in FIG. 1. Further, the sheets must be wrapped (which may be wrapping using plastic or banding such as with plastic or paper). The wrapping can occur using a wrapping system 262 prior to or subsequent to forming the clips depending on the type of product. The wrapping system 262 is represented schematically upstream of the log saw 260 in FIG. 1. The separated stacks 266 are typically sent to an accumulator 268 upstream of the wrapping system 262 and log saw 260 where the stacks 266 are stored as the stacks 266 wait to pass through the log saw 260 and wrapping system 262. The stacks 266 are carried away from the separators 108, 112 to the accumulator 268 by a conveying system in the form of conveyor 270. The separators 108, 112 can place the stacks 266 onto the conveyor 270 directly or through intervening structure.

Typically, each folding arrangement would have its own dedicated accumulator, wrapping system and log saw. However, in an embodiment of the instant invention, the two folding arrangements 106, 110 could feed their stacks to a same accumulator, wrapping system and log saw further reducing the number of components required. Similar to the upstream web handling arrangement, the accumulator, wrapping system and log saw can typically be operated at a throughput speed greater than the folding arrangements. Thus, further efficiencies can be gained. While not shown, the accumulator, wrapping system and log saw would be downstream from the folding arrangements 106, 110.

This system thus allows for substantially twice the output but with significantly less than twice the cost, floor space or labor costs as compared to two separate machines.

To assist in making the transfer between adjacent web processing rolls (e.g. knife rolls, transfer rolls, lap rolls, folding rolls, etc.) that have different surface speeds, the vacuum ports of the corresponding rolls may include pivoting vacuum ports as disclosed in pending U.S. patent application Ser. No. 14/737,216, entitled "FOLDING MACHINE AND METHODS," assigned to the assignee of the instant application, the teachings and disclosures of which are incorporated herein by reference thereto in their entireties (also referred to herein as "the '216 application").

In particular, it would be beneficial to utilize pivoting vacuum ports as disclosed in the '216 application for vacuum ports 143 and 185 of the first and second lap rolls 138, 178. The benefit of using these ports as the pivoting vacuum port is that the pivoting action provided by the pivoting vacuum port could be used for the surface speed difference between the lap rolls 138, 178 and the first folding rolls 146, 186 as well as between the first lap roll 138 and the knife roll 128 and the transfer roll 172 and the second lap roll 178.

More particularly and with reference to the knife roll 128, first lap roll 138 and first folding roll 146, if port 143 were a pivoting vacuum port, port 143 could pivot in a first direction when making the transfer between the first lap roll 138 and the first folding roll 146, namely to effectively slow down the surface speed of the first lap roll 138 to match the slower surface speed of the first folding roll 146 at nip 158 (or at a minimum reduce the surface speed difference therebetween). Thereafter, as the vacuum port 143 progresses around toward nip 140 as the first lap roll 138 rotates about rotational axis 144, the vacuum port 143 could pivot in a second opposite direction when making the transfer between the knife roll 128 and the first lap roll 138, namely to effectively speed up the surface speed of the first lap roll 138 to match the faster surface speed of the knife roll 128 at nip 140 (or at a minimum reduce the surface speed difference therebetween).

While this is one implementation of pivoting vacuum ports, other vacuum ports in other processing rolls could incorporate the pivoting vacuum port concept to improve the transfer between adjacent processing rolls.

The web processing system of FIG. 1 is only one implementation of the concept presented herein of using a single continuous web of material to feed sheets to multiple folding arrangements.

Figure 8:
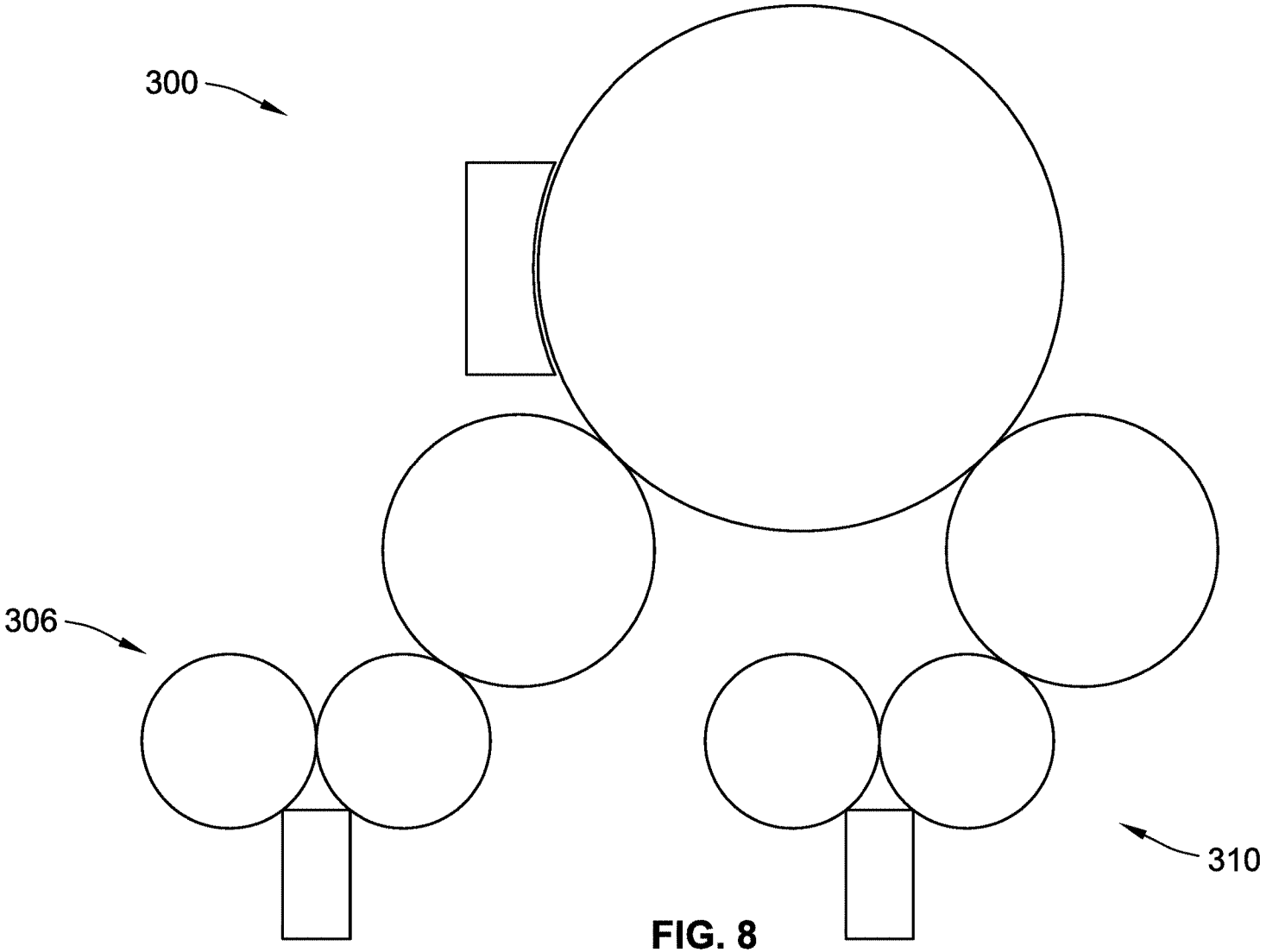
FIG. 8 is an alternative embodiment of a cutting arrangement and folding arrangements use able in a web processing system.

FIG. 8 illustrates a schematic representation of a portion of an alternative implementation of web processing system 300. This web processing system 300 would incorporate a web handling arrangement similar web handling arrangement 102 discussed previously, but not shown in FIG. 8.

This embodiment is substantially similar to that as illustrated in FIG. 2 but without the inclusion of transfer roll 172 as part of the second sheet path between the knife roll 128 to the second folding arrangement 110.

The embodiment of FIG. 8 loses the symmetry provided in the embodiment of FIG. 2. However, the embodiment of FIG. 8 provides at least one benefit over the prior embodiment. It is common for the web of material used to form the sheets to be different on the two sides. This difference can take many forms but for example it is common to laminate continuous webs together, such as to make a multiple ply web, with decorative printing or embossing patterns on one web and not on the other. The concept of FIG. 8 will allow both stacks of product formed from the first and second folding arrangements 306, 310 to have the same orientation. The embodiment of FIG. 2 causes the stacks formed from the first folding arrangement 106 to be inverted relative to the stacks being formed from the second folding arrangement 110. As such, one of the stacks could have a decorative feature that is desired to be facing outward actually facing inward.

However, both embodiments incorporate the concept of feeding two separate interfolding arrangements from a single processed continuous web of material as well as using a single cutting arrangement to form the individual sheets from the single processed continuous web of material.

Again, while the illustrated embodiment illustrated forming 3-panel multifold interfolded product for both folding arrangements 106, 110, different systems could form different product or have different product formed from each of the folding arrangements 106, 110. However, further efficiencies can be gained when both folding arrangements form a same product as further downstream components can be consolidated such that multiple lines of downstream components need not be provided. This would not likely be the case if the folding arrangements were used to form stacks having different characteristics, e.g. size, number of panels, interfolded v. non-interfolded, etc.

Further, while it would not be optimum, it would be possible to run the folding arrangements 106, 110 separately depending on the needs of the customer. This would be particularly true if the system had folding arrangements that produced different products but only a single set of downstream components that could not be mixed together. When forming one product with the first folding arrangement 106, all sheets could be sent to the first folding arrangement 106 and the second folding arrangement 110 could be idle. However, because the second folding arrangement 110 is not being used, there would be no comingling of different types of stacks of product such that the downstream components (e.g. wrapping system and log saw) could be configured for that particular product.

Then, if the product of the second folding arrangement 110 is desired, the first folding arrangement 106 could be stopped and the second folding arrangement 110 could be activated with all sheets being sent to the second folding arrangement 110 with the first folding arrangement remaining idle. If necessary, the downstream components (e.g. log saw and wrapping system) could be reconfigured to handle this different product. Again, there would be no comingling of different products. However, this would also allow a producer to be able to form two different types of product without needing to purchase two entire web processing lines.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A web processing system for processing a processed continuous web of material into a plurality of folded sheets, comprising:

a web handling arrangement;

a cutting arrangement, the web handling arrangement supplying a processed continuous web of material to the cutting arrangement, the cutting arrangement cutting the processed continuous web of material into a stream of sheets, the cutting arrangement includes a knife roll;

a first folding arrangement downstream from the cutting arrangement configured to receive sheets from the cutting arrangement and form first folded sheets, the first folding arrangement includes counter-rotating first and second folding rolls;

a second folding arrangement downstream from the cutting arrangement configured to receive sheets from the cutting arrangement and form second folded sheets, the second folding arrangement includes counter-rotating first and second folding rolls;

a first lap roll operably positioned between the knife roll and the first folding roll of the first folding arrangement; and a second lap roll operably positioned between the knife roll and the first folding roll of the second folding arrangement;

wherein one of the first and second folding rolls of the first folding arrangement includes a tucker and the other one of the first and second folding rolls of the first folding arrangement includes a gripper that operatively cooperates with the tucker to fold the first sheets; and one of the first and second folding rolls of the second folding arrangement includes a tucker and the other one of the first and second folding rolls of the second folding arrangement includes a gripper that operatively cooperates with the tucker to fold the second sheet.

2. The web processing system of claim 1, wherein:

a first sheet path is defined between the cutting arrangement and the first folding arrangement, a first set of sheets of the stream of sheets travels along the first sheet path from the cutting arrangement to the first folding arrangement;

a second sheet path is defined between the cutting arrangement and the second folding arrangement, a second set of sheets of the stream of sheets travels along the second sheet path from the cutting arrangement to the second folding arrangement.

3. The web processing system of claim 1, wherein the first folding arrangement forms folded product of a first type and the second folding arrangement forms folded product of a second type.

4. The web processing system of claim 1, wherein the first and second folding arrangements are interfolding arrangements.

5. The web processing system of claim 1, wherein the first and second folding arrangements are non-interfolding arrangements.

6. The web processing system of claim 1, further comprising a transfer roll positioned between the knife roll and the second lap roll;

wherein:

a first set of sheets from the stream of sheets travels from the knife roll to the first folding roll of the first folding arrangement by passing from the knife roll to the first lap roll and then from the first lap roll to the first folding roll of the first folding arrangement; and a second set of sheets from the stream of sheets travels from the knife roll to the first folding roll of the second folding arrangement by passing from the knife roll to the transfer roll, from the transfer roll to the second lap roll and then from the second lap roll to the first folding roll of the second folding arrangement.

7. A web processing system for processing a processed continuous web of material into a plurality of folded sheets, comprising:

a web handling arrangement;

a cutting arrangement, the web handling arrangement supplying a processed continuous web of material to the cutting arrangement, the cutting arrangement cutting the processed continuous web of material into a stream of sheets, the cutting arrangement includes a knife roll;

a first folding arrangement downstream from the cutting arrangement configured to receive sheets from the cutting arrangement and form first folded sheets, the first folding arrangement includes counter-rotating first and second folding rolls;

a second folding arrangement downstream from the cutting arrangement configured to receive sheets from the cutting arrangement and form second folded sheets, the second folding arrangement includes counter-rotating first and second folding rolls;

a first lap roll operably positioned between the knife roll and the first folding roll of the first folding arrangement; and a second lap roll operably positioned between the knife roll and the first folding roll of the second folding arrangement wherein the knife roll rotates at a first surface speed, the first and second lap rolls rotate at a second surface speed being slower than the first surface speed and the first folding rolls of the first and second folding arrangements rotate at a third surface speed being slower than the second surface speed.

8. The web processing system of claim 7, wherein the first and second folding arrangements are interfolding folding arrangements.

9. The web processing system of claim 1, further comprising:

a first separator downstream from the first folding arrangement forming first stacks from the first folded sheets;

a second separator downstream from the second folding arrangement forming second stacks from the first folded sheets;

a single conveying system receiving the first and second stacks and carrying the first and second stacks away from the first and second folding arrangements.

10. A method of processing a processed continuous web of material into folded sheets comprising:

supplying, with a web handling arrangement, a processed continuous web of material to a cutting arrangement;

cutting, with the cutting arrangement, the processed continuous web of material into a stream of sheets, the cutting arrangement includes a knife roll;

receiving, by a first folding arrangement downstream from the cutting arrangement, sheets formed from the cutting arrangement, the first folding arrangement includes counter-rotating first and second folding rolls;

receiving, by a second folding arrangement downstream from the cutting arrangement, sheets formed from the cutting arrangement, the second folding arrangement includes counter-rotating first and second folding rolls;

a first lap roll operably positioned between the knife roll and the first folding roll of the first folding arrangement;

a second lap roll operably positioned between the knife roll and the first folding roll of the second folding arrangement;

wherein one of the first and second folding rolls of the first folding arrangement includes a tucker and the other one of the first and second folding rolls of the first folding arrangement includes a gripper that operatively cooperates with the tucker to fold the first sheets; and one of the first and second folding rolls of the second folding arrangement includes a tucker and the other one of the first and second folding rolls of the second folding arrangement includes a gripper that operatively cooperates with the tucker to fold the second sheet.

11. The method of claim 10, wherein:

a first sheet path is defined between the cutting arrangement and the first folding arrangement;

a second sheet path is defined between the cutting arrangement and the second folding arrangement;

further comprising:

directing a first set of sheets of the stream of sheets along the first sheet path from the cutting arrangement to the first folding arrangement;

directing a second set of sheets of the stream of sheets along the second sheet path from the cutting arrangement to the second folding arrangement.

12. The method of claim 11, further comprising forming, with the first folding arrangement, folded sheets of a first type; and forming, with the second folding arrangement, folded sheets of a second type.

13. The method of claim 11, further comprising interfolding, with the first folding arrangement, the first set of sheets and interfolding, with the second folding arrangement, the second set of sheets.

14. The method of claim 10, further comprising non-interfolding, with the first folding arrangement, the first set of sheets and non-interfolding, with the second folding arrangement, the second set of sheets.

15. The method of claim 10, further comprising a transfer roll positioned between the knife roll and the second lap roll;

further comprising:

a first set of sheets from the stream of sheets travels from the knife roll to the first folding roll of the first folding arrangement by passing from the knife roll to the first lap roll and then from the first lap roll to the first folding roll of the first folding arrangement; and a second set of sheets from the stream of sheets travels from the knife roll to the first folding roll of the second folding arrangement by passing from the knife roll to the transfer roll, from the transfer roll to the second lap roll and then from the second lap roll to the first folding roll of the second folding arrangement.

16. A method of processing a processed continuous web of material into folded sheets comprising:

supplying, with a web handling arrangement, a processed continuous web of material to a cutting arrangement;

cutting, with the cutting arrangement, the processed continuous web of material into a stream of sheets, the cutting arrangement includes a knife roll;

receiving, by a first folding arrangement downstream from the cutting arrangement, sheets formed from the cutting arrangement, the first folding arrangement includes counter-rotating first and second folding rolls;

receiving, by a second folding arrangement downstream from the cutting arrangement, sheets formed from the cutting arrangement, the second folding arrangement includes counter-rotating first and second folding rolls;

a first lap roll operably positioned between the knife roll and the first folding roll of the first folding arrangement;

a second lap roll operably positioned between the knife roll and the first folding roll of the second folding arrangement;

rotating the knife roll at a first surface speed;

rotating the first and second lap rolls at a second surface speed being slower than the first surface speed; and rotating the first folding rolls of the first and second folding arrangements at a third surface speed being slower than the second surface speed.

17. The method of claim 16, wherein the first and second folding arrangements are interfolding folding arrangements.

18. The method of claim 10, wherein the cutting arrangement directly transfers sheets from the knife roll to the first and second lap rolls.

19. The method of claim 11, wherein the first set of sheets and second set of sheets are formed by alternating sheets formed by the cutting arrangement from the processed continuous web of material.

20. The method of claim 11, further comprising:

forming, with the first folding arrangement, first folded product from the first set of sheets;

forming, with the second folding arrangement, second folded product from the second set of sheets;

separating the first folded product into first stacks with a first separator downstream from the first folding arrangement;

separating the second folded product into second stacks with a second separator downstream from the second folding arrangement; and conveying, with a conveying system, the first and second stacks away from the first and second folding arrangements.

* * * * *